US006663365B2

(12) United States Patent
Mori et al.

(10) Patent No.: US 6,663,365 B2
(45) Date of Patent: Dec. 16, 2003

(54) SCROLL TYPE COMPRESSOR

(75) Inventors: Tatsushi Mori, Kariya (JP); Masahiro Kawaguchi, Kariya (JP); Yasushi Watanabe, Kariya (JP); Yoshiharu Yoshida, Kariya (JP)

(73) Assignee: Kabushiki Kaisha Toyota Jidoshokki, Kariya (JP)

( * ) Notice: Subject to any disclaimer, the term of this patent is extended or adjusted under 35 U.S.C. 154(b) by 0 days.

(21) Appl. No.: 10/057,700

(22) Filed: Jan. 24, 2002

(65) Prior Publication Data

US 2002/0098101 A1 Jul. 25, 2002

(30) Foreign Application Priority Data

Jan. 25, 2001 (JP) ..... 2001-016907

(51) Int. Cl.[7] ..... F03C 2/00
(52) U.S. Cl. ..... 418/55.2; 418/55.4; 418/178
(58) Field of Search ..... 418/55.2, 55.4, 418/178

(56) References Cited

U.S. PATENT DOCUMENTS

| | | | | |
|---|---|---|---|---|
| 4,487,560 A | * | 12/1984 | Uchikawa et al. | 418/55.2 |
| 4,609,334 A | * | 9/1986 | Muir et al. | 418/55.2 |
| 4,802,831 A | * | 2/1989 | Suefuji et al. | 418/55.2 |
| 5,767,186 A | | 6/1998 | Shimokusuzono et al. | |

FOREIGN PATENT DOCUMENTS

| | | | | |
|---|---|---|---|---|
| EP | 0 404 512 A2 | | 12/1990 | |
| EP | 0 855 508 A1 | | 7/1998 | |
| EP | 1 225 338 A2 | | 7/2002 | |
| JP | 01130083 A | * | 5/1989 | F04C/18/02 |
| JP | 3-225002 | | 10/1991 | |
| JP | 8-3538 | | 1/1996 | |
| JP | 08042468 A | * | 2/1996 | F04C/18/02 |
| JP | 10-141255 | | 5/1998 | F04C/18/02 |
| WO | WO 00/06906 | | 2/2000 | |

* cited by examiner

*Primary Examiner*—Thomas Denion
*Assistant Examiner*—Theresa Trieu
(74) *Attorney, Agent, or Firm*—Morgan & Finnegan, LLP

(57) ABSTRACT

A scroll type compressor has a fixed scroll, a movable scroll and a plurality of sealing members. The fixed scroll includes a fixed base plate and a fixed volute portion, which is formed on the fixed base plate. The fixed volute portion is tapered and the corners of the proximal end of the fixed volute portion are arched. The movable scroll is arranged to be engaged with the fixed scroll. The movable scroll includes a movable base plate and a movable volute portion, which is formed on the movable base plate. The movable volute portion is tapered and the corners of the proximal end of the movable volute portion are arched. One of the sealing members is located on the fixed base plate. The other of the sealing members is located on the movable base plate.

6 Claims, 5 Drawing Sheets

SCROLL TYPE COMPRESSOR

BACKGROUND OF THE INVENTION

The present invention relates to a scroll type compressor. Particularly, the present invention pertains to structures of a fixed scroll and a movable scroll used in a scroll type compressor.

A typical scroll type compressor has a fixed scroll and a movable scroll in a housing. The fixed scroll includes a fixed base plate and a fixed volute portion, which is formed on the fixed base plate. The fixed volute portion has a proximal end and a distal end relative to the fixed base plate. The movable scroll includes a movable base plate and a movable volute portion, which is formed on the movable base plate. The movable volute portion has a proximal end and a distal end relative to the movable base plate. The fixed scroll is engaged with the movable scroll. A number of compression chambers are formed between the fixed scroll and the movable scroll. When the movable scroll orbits the axis of the fixed scroll, each compression chamber moves from the peripheral portion (or outside portion) of the fixed volute portion toward the center of the fixed volute portion. Gas drawn into each compression chamber from the peripheral portion of the fixed volute portion is gradually compressed as the compression chamber moves.

When the scroll type compressor is operated, each proximal end portion of the fixed volute portion and the movable volute portion receives a bending moment repeatedly. The bending moment promotes deterioration of the scrolls. This shortens the life of the compressor. Therefore, a compressor that prevents the scrolls from being deteriorated and maintains the compression performance has been proposed in a prior art disclosed in, for example, Japanese Laid-Open Patent Publication No. 10-141255.

FIG. 5 is an enlarged partial cross-sectional view illustrating a fixed scroll 1 and a movable scroll 2 of the above publication. The fixed scroll 1 has a fixed volute portion 6 and the movable scroll 2 has a movable volute portion 8. The fixed volute portion 6 has proximal end corners 6*b* and distal end corners 6*c*. The movable volute portion 8 has proximal end corners 8*b* and distal end corners 8*c*. The proximal end corners 6*b* of the fixed volute portion 6 and the proximal end corners 8*b* of the movable volute portion 8 are arched to prevent the concentration of stress. This shape increases the fatigue strength under the bending moment generated when the compressor operates. Each distal end corner 6*c* of the fixed volute portion 6 is chamfered not to interfere with the corresponding proximal end corner 8*b* of the movable volute portion 8. The fixed volute portion 6 and the movable volute portion 8 define a compression chamber 15, which has a predetermined volume. A first chip sealing 17 is located on the distal end of the fixed volute portion 6. A wear-resistant plate 21, which is made of metal, is located on a bottom surface 5*a* between adjacent parts of the fixed volute portion 6. The wear-resistant plate 21 contacts a second chip sealing 18, which is arranged on the distal end portion of the movable volute portion 8. The wear-resistant plate 21 is spaced from the distal end portion of the movable volute portion 8. The distance between the wear-resistant plate 21 and the distal end portion of the movable volute portion 8 is equivalent to the length of the part of the second chip sealing 18 that protrudes from the distal end portion. Therefore, the distal end corners 8*c* of the movable volute portion 8 are not chamfered. This structure permits the compression chamber 15 to be reliably sealed. Thus, the scroll type compressor is smoothly operated.

An air conditioning apparatus for vehicles these days is required to have a reduced size and weight and to have a compression mechanism that discharges highly pressurized gas. However, some parts in a compressor are made of aluminum to reduce weight. Thus, a compression mechanism must have improved durability against the high pressure. Furthermore, a prior art sealing method is insufficient and improvement of the sealing is also desired.

Specifically, the fixed volute portion 6 and the movable volute portion 8 illustrated in FIG. 5 are plate-like and have a substantially uniform thickness. Thus, if the thickness of the fixed volute portion 6 and the movable volute portion 8 is reduced for reducing weight, the thickness of each proximal end portion of fixed volute portion 6 and movable volute portion 8 is not enough. Thus, the strength of each proximal end portion is insufficient. When the first chip sealing 17 is fitted to the distal end portion of the fixed volute portion 6, the thickness of the distal end portion needs to be the sum of the width a of the first chip sealing 17 and the thickness b of the outer wall multiplied by two required to support the first chip sealing 17. For example, when the curvature of the proximal end corners 8*b* of the movable volute portion 8 is increased to increase the strength, the curvature of the distal end corners 6*c* of the fixed volute portion 6 needs to be increased accordingly. As a result, the thickness of the fixed volute portion 6 is increased.

The position of the wear-resistant plate 21 is determined by two positioning pieces 20 with respect to the fixed scroll 1. However, each positioning piece 20 deforms the fixed volute portion 6 or damages the wall of the fixed volute portion 6.

Gas flows between a space between the distal end surface of the movable volute portion 8 and the surface of one of the positioning pieces 20 that faces the distal end surface of the movable volute portion 8, and a space between the positioning piece 20 and the corresponding proximal end corner 6*b*. Therefore, the gas could leak from the compressor.

SUMMARY OF THE INVENTION

The objective of the present invention is to provide a scroll type compressor that is reduced in weight and size and has great fatigue strength and a scroll that is sufficiently sealed.

To achieve the foregoing objective, the present invention provides a scroll type compressor for compressing gas. The compressor includes a fixed scroll, a movable scroll, a compression chamber, and a plurality of sealing members. The fixed scroll includes a fixed base plate and a fixed volute portion, which is formed on the fixed base plate. The fixed volute portion is tapered and the corners of the proximal end of the fixed volute portion are arched. The movable scroll is arranged to be engaged with the fixed scroll. The movable scroll includes a movable base plate and a movable volute portion, which is formed on the movable base plate. The movable volute potion is tapered and the corners of the proximal end of the movable volute portion are arched. The compression chamber is defined between the fixed scroll and the movable scroll. The compression chamber moves from the peripheral portion of the fixed volute potion toward the center as the movable scroll orbits the axis of the fixed scroll. One of the sealing members is located on the fixed base plate and the other
of the sealing members is located on the movable base plate.

Other aspects and advantages of the invention will become apparent from the following description, taken in conjunction with the accompanying drawings, illustrating by way of example the principles of the invention.

BRIEF DESCRIPTION OF THE DRAWINGS

The invention, together with objects and advantages thereof, may best be understood by reference to the following description of the presently preferred embodiments together with the accompanying drawings in which.

DETAILED DESCRIPTION OF THE PREFERRED EMBODIMENTS

A scroll type compressor according to a first embodiment of the present invention will now be described with reference to FIGS. 1 and 2.

Figure 1:
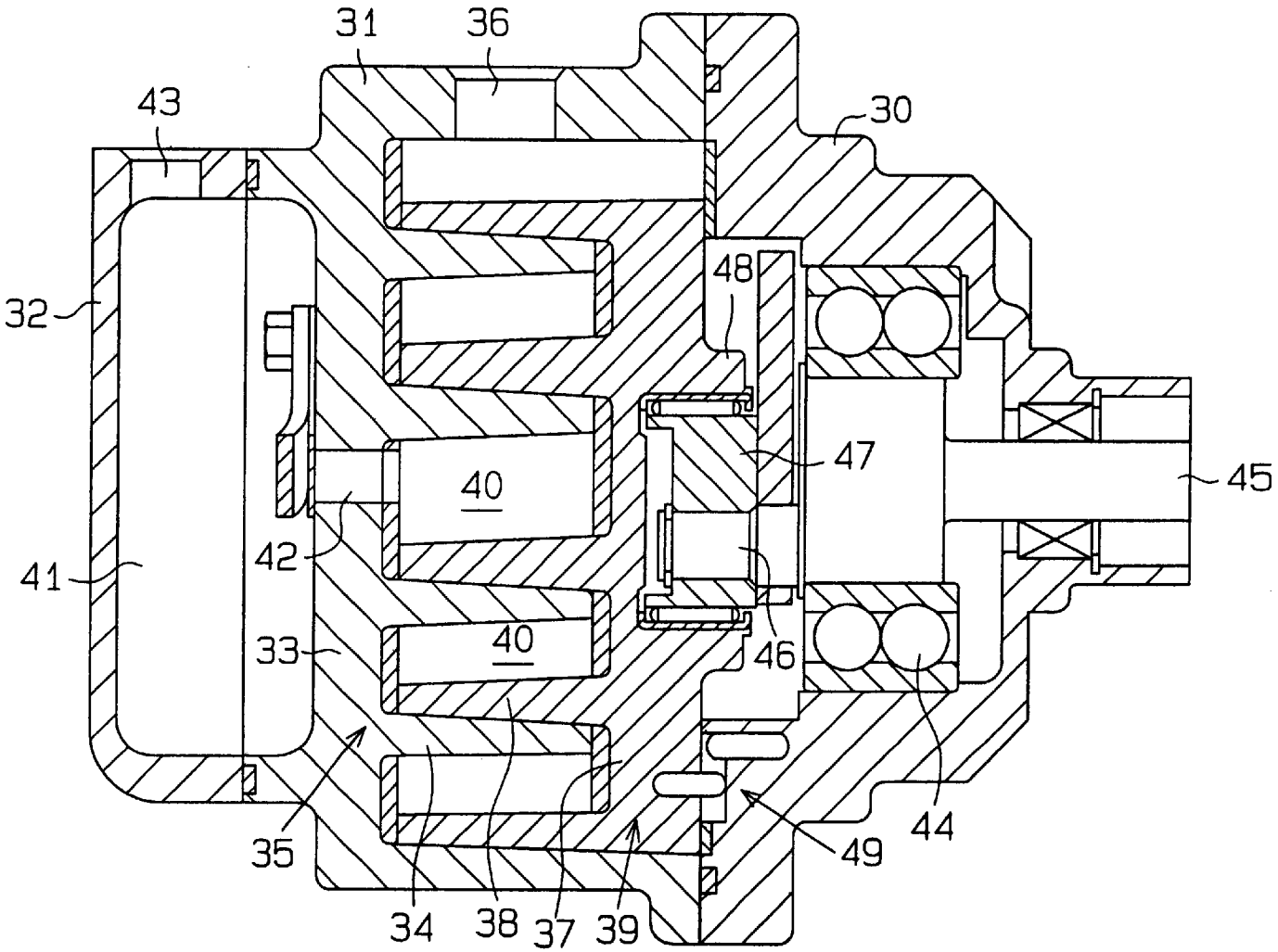
FIG. 1 is a cross-sectional view illustrating a scroll type compressor according to a first embodiment of the present invention.

As shown in FIG. 1, a scroll type compressor includes a front housing member 30, a center housing member 31, and a rear housing member 32. The front housing member 30, the center housing member 31, and the rear housing member 32 form a housing of the compressor.

A fixed scroll 35 is integrally formed with the center housing member 31. The fixed scroll 35 includes a fixed base plate 33 and a fixed volute portion 34, which is formed on the fixed base plate 33. The center housing member 31 is communicated with an external refrigerant circuit (not shown) by an inlet 36 for drawing in refrigerant. A movable scroll 39 is accommodated between the center housing member 31 and the front housing member 30. The movable scroll 39 includes a movable base plate 37 and a movable volute portion 38, which is formed on the movable base plate 37. The movable volute portion 38 is engaged with the fixed volute portion 34.

The fixed scroll 35 and the movable scroll 39 define a number of compression chambers 40. A discharge chamber 41 is defined between the center housing member 31 and the rear housing member 32. The fixed base plate 33 of the fixed scroll 35 includes a discharge port 42 at its substantial center for discharging refrigerant gas compressed in the compression chambers 40. The rear housing member 32 includes an outlet 43 for discharging the refrigerant gas in the discharge chamber 41 to the external refrigerant circuit.

A drive shaft 45 is located at the center of the front housing member 30. One end of the drive shaft 45 extends outside the compressor. The drive shaft 45 is rotatably supported by the front housing member 30 through a bearing 44. The drive shaft 45, which extends outside the compressor, is connected to the external power source, such as an engine, through a pulley (not shown). The drive shaft 45 has an eccentric shaft 46. The eccentric shaft 46 is engaged with a boss 48 of the movable scroll 39 through a bush 47. An anti-rotation mechanism 49 permits the movable scroll 39 to orbit the axis of the fixed scroll 35 and prevents the movable scroll 39 from rotating about its own axis.

Figure 2:
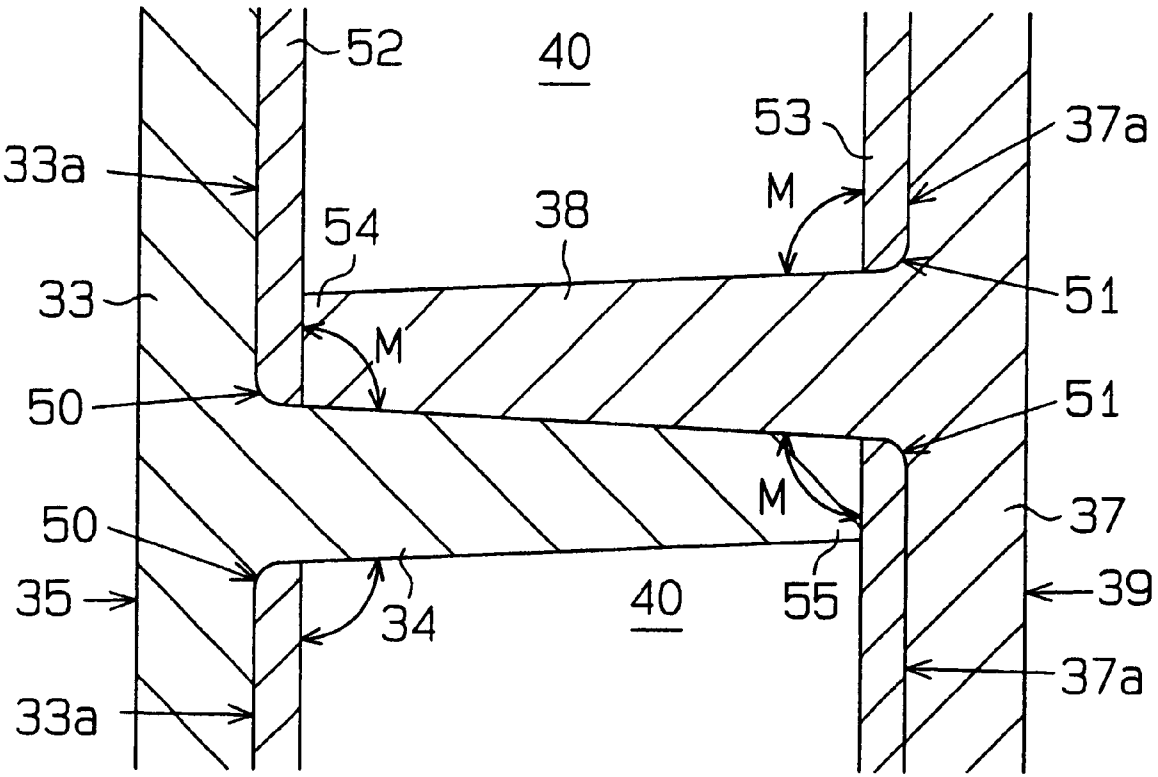
FIG. 2 is an enlarged partial cross-sectional view illustrating the fixed scroll and the movable scroll of the compressor shown in FIG. 1.

As shown in FIGS. 1 and 2, the fixed volute portion 34 and the movable volute portion 38 are tapered. As shown in FIG. 2, each side wall of the fixed volute portion 34 is parallel to the opposite side wall of the movable volute portion 38. The side walls of the fixed volute portion 34 are inclined by the same inclination angle M (first inclination angle) with respect to the fixed base plate 33. In the same manner, the side walls of the movable volute portion 38 are inclined by the same angle M (second inclination angle) with respect to the movable base plate 37. Furthermore, the first inclination angle M and the second inclination angle M are equal. The inclination angle M is obtained by a draft angle required for the release from a mold.

Figure 5:
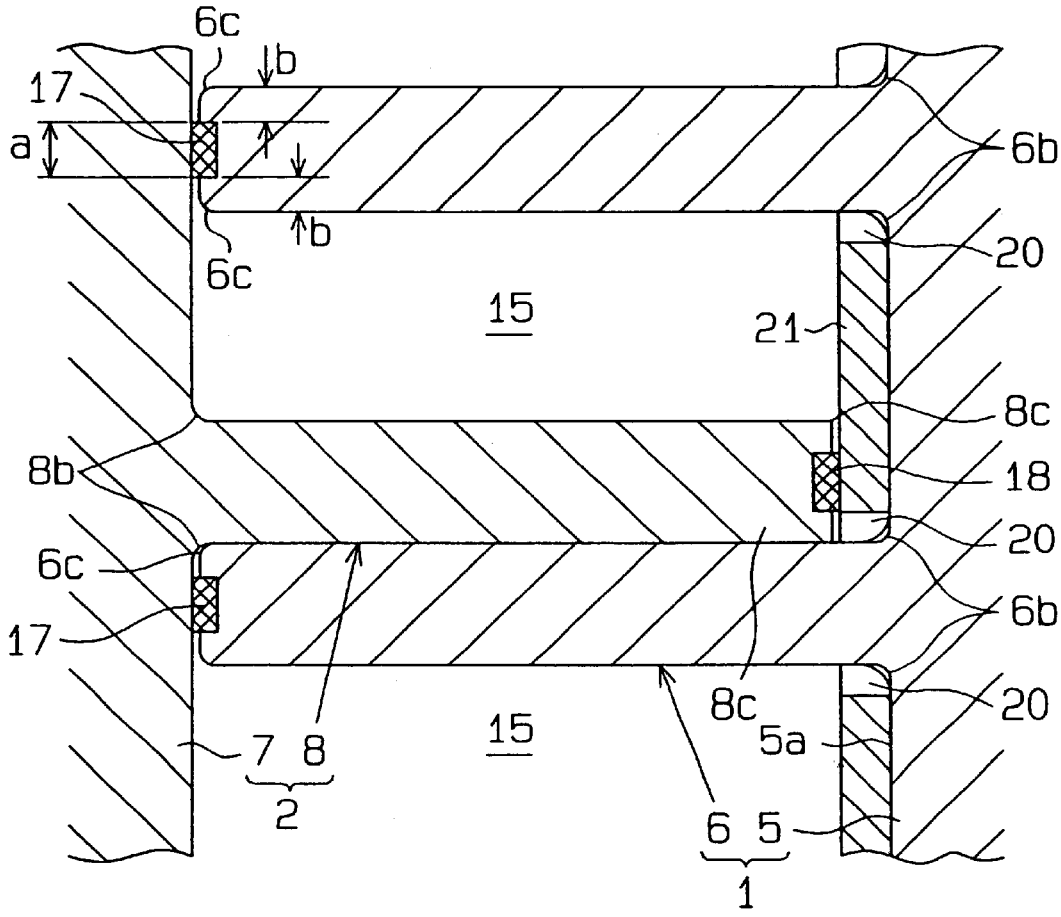
Fig.5 (Prior Art)
FIG. 5 is an enlarged partial cross-sectional view illustrating a prior art fixed scroll and movable scroll.

As shown in FIG. 2, the fixed volute portion 34 and the fixed base plate 33 are connected by arched proximal end corners 50 of the fixed volute portion 34. The movable volute portion 38 and the movable base plate 37 are connected by arched proximal end corners 51 of the movable volute portion 38. A first sealing member 52 is arranged on a bottom surface 33*a* of the fixed base plate 33 between adjacent parts of the fixed volute portion 34. A second sealing member 53 is arranged on a bottom surface 37*a* of the movable base plate 37 between adjacent parts of the movable volute portion 38. The first sealing member 52 covers the arched portion of the proximal end corners 50 of the fixed volute portion 34 and the second sealing member 53 covers the proximal end corners 51 of the movable volute portion 38. When the fixed scroll 35 is engaged with the movable scroll 39, the distal end of the fixed volute portion 34 slides along the second sealing member 53 and the distal end of the movable volute portion 38 slides along the first sealing member 52. The distal end corners 55 of the fixed volute portion 34 do not contact with the proximal end corners 51 of the movable volute portion 38. The distal end corners 54 of the movable volute portion 38 do not contact with the proximal end corners 50 of the fixed volute portion 34. Therefore, the distal end corners 55 of the fixed volute portion 34 and the distal end corners 54 of the movable volute portion 38 need not be chamfered. The same resin used as the material of the first and the second chip sealings 17, 18 shown in FIG. 5 is suitable for the material of the first and second sealing members 52, 53.

The operation of the compressor constructed as above will now be described below. The external drive source such as an engine drives the drive shaft 45 through the pulley (not shown). When the drive shaft 45 is rotated, the movable scroll 39 orbits the axis of the fixed scroll 35. The volume of each compression chamber 40 changes as the movable scroll 39 orbits the axis of the fixed scroll 35. Refrigerant gas is drawn into one of the compression chambers 40 from the external refrigerant circuit through the inlet 36. The refrigerant gas in the compression chamber 40 is then compressed to a predetermined pressure as the volume of the compression chamber 40 is reduced. The compressed refrigerant gas is discharged to the discharge chamber 41 through the discharge port 42. The refrigerant gas in the discharge chamber 41 is discharged to the external refrigerant circuit through the outlet 43.

The scroll type compressor according to the first embodiment provides the following advantages.

When refrigerant gas is compressed in the compressor, a bending moment is repeatedly applied to each proximal end of the fixed volute portion 34 and the movable volute portion 38. However, the proximal end corners 50 of the fixed volute portion 34 and the proximal end corners 51 of the movable volute portion 38 are arched. Therefore, the concentration of stress due to the bending moment repeatedly applied to each proximal end portion of the fixed volute portion 34 and the movable volute portion 38 is avoided. Thus, the compressor maintains a certain fatigue strength. Furthermore, the fixed volute portion 34 and the movable volute portion 38 are tapered and each proximal end of the fixed volute portion 34 and the movable volute portion 38 has sufficient thickness. This further increases the fatigue strength. As a result, the life of the compressor is extended.

The compression chambers 40 are reliably sealed with the first sealing member 52, which is located on the bottom surface 33*a* of the fixed base plate 33, and the second sealing member 53, which is located on the bottom surface 37*a* of the movable base plate 37. Therefore, the compression efficiency is sufficient. The first and the second sealing members 52, 53 are used instead of the prior art chip seals. Therefore, the thickness of each distal end portion of the fixed volute portion 34 and the movable volute portion 38 is minimized. This reduces the size and weight of the compressor.

The fixed volute portion 34 and the movable volute portion 38 are arranged such that each side wall of the fixed volute portion 34 is parallel to the opposite side wall of the movable volute portion 38. Therefore, the compression chambers 40 are reliably sealed. The fixed scroll 35 and the movable scroll 39 are formed by utilizing the same draft angle. Therefore, the compression chambers 40 are defined by the fixed volute portion 34 and the movable volute portion 38 having the same inclination angle M. Thus, the compression chambers 40, which are reliably sealed, are easily obtained. Furthermore, the inclination angle M of the side walls of each of the fixed volute portion 34 and the movable volute portion 38 are designed to be equal. This facilitates the manufacturing of molds. Since a draft angle required for the release from a mold is utilized for each side walls of the fixed volute portion 34 and the movable volute portion 38, machining is not required and the number of manufacturing steps is reduced. The smooth surface formed by molding is utilized as it is. Therefore, the compressor with a great surface hardness and a great durability is obtained.

The first sealing member 52 covers the arched portion of the proximal end corners 50 of the fixed volute portion 34 and the second sealing member 53 covers the proximal end corners 51 of the movable volute portion 38. Therefore, the chamfering processes of the distal end corners 54 of the fixed volute portion 34 and the distal end corners 55 of the movable volute portion 38 are omitted.

Figure 3:
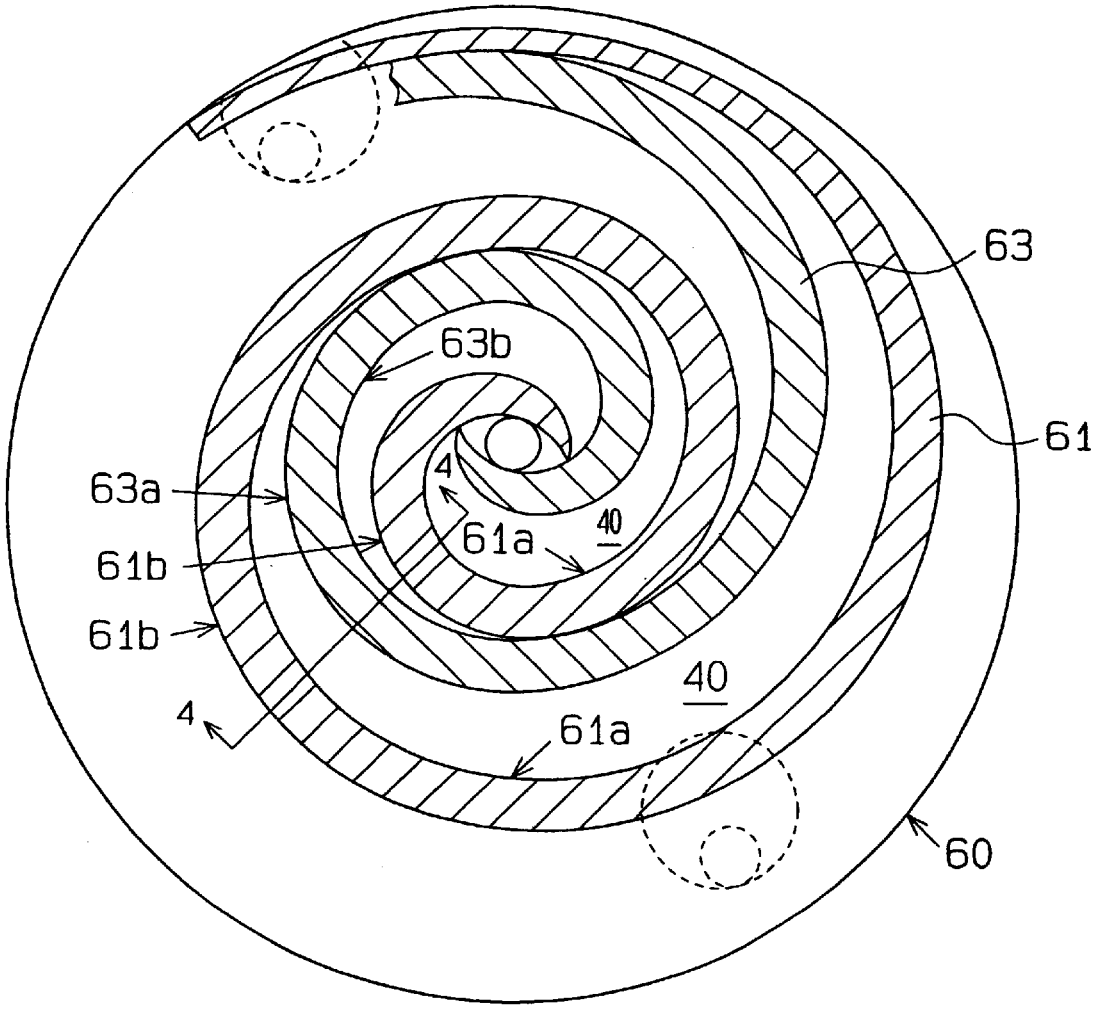
FIG. 3 is a partial cross-sectional view of a scroll type compressor according to a second embodiment of the present invention.
Figure 4:
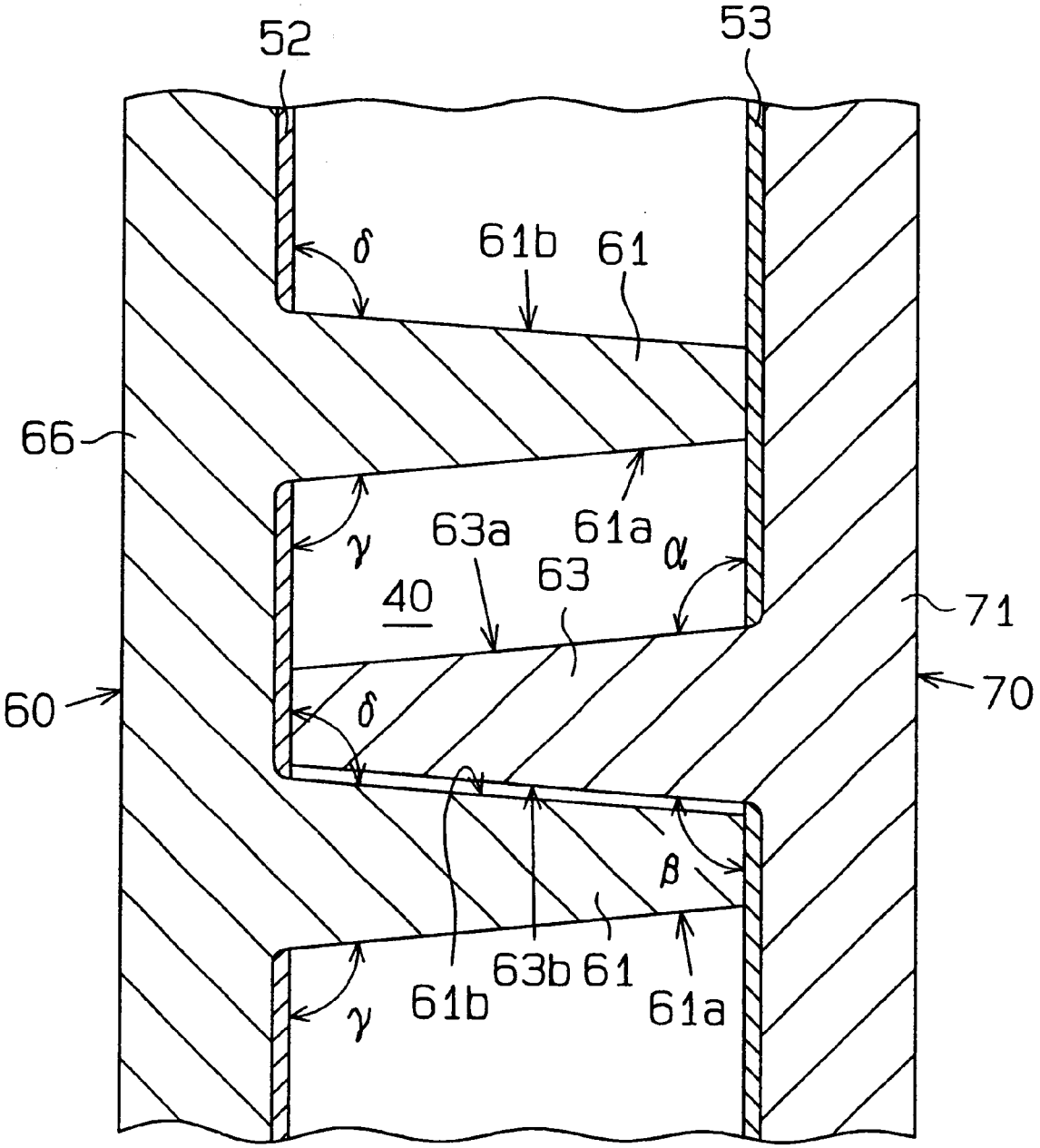
FIG. 4 is a cross-sectional view taken along line 4—4 in FIG. 3.

A scroll type compressor according to a second embodiment of the present invention will now be described with reference to FIGS. 3 and 4. The differences from the embodiment of FIGS. 1 and 2 will mainly be discussed below. In the second embodiment, the structure of the fixed scroll 60 and the movable scroll 70 differs from that of the first embodiment. Other structure of the compressor is the same as the first embodiment and the detailed explanations are omitted. FIG. 3 shows the fixed volute portion 61 of the fixed scroll 60 being engaged with the movable volute portion 63 of the movable scroll 70 (see FIG. 4). As shown in FIG. 4, the inclination angle $\alpha$ of the first side wall 63*a* of the movable volute portion 63 with respect to the movable base plate 71 of the movable scroll 70 differs from the inclination angle $\beta$ of the second side wall 63*b* of the movable volute portion 63 with respect to the movable base plate 71 of the movable scroll 70. Similarly, the inclination angle $\gamma$ of the first side wall 61*a* of the fixed volute portion 61 with respect to the fixed base plate 66 of the fixed scroll 60 differs from the inclination angle $\delta$ of the second side wall 61*b* of the fixed volute portion 61 with respect to the fixed base plate 66 of the fixed scroll 60. The fixed scroll 60 and the movable scroll 70 are formed as above when, for example, the draft angle of the side walls are required to be changed between the fixed scrolls 60 and the movable scroll 70 in accordance with the requirements of the molding procedures. The inclination angle $\gamma$ of the first side wall 61*a* of the fixed volute portion 61, which faces the first side wall 63*a* of the movable volute portion 63, is equal to the inclination angle $\alpha$ of the first side wall 63*a* of the movable volute portion 63. Furthermore, the inclination angle $\delta$ of the second side wall 61*b* of the fixed volute portion 61, which faces the second side wall 63*b* of the movable volute portion 63, is equal to the inclination angle $\beta$ of the second side wall 63*b* of the movable volute portion 63.

The second embodiment provides the following advantages in addition to the advantages of the first embodiment illustrated in FIGS. 1 and 2.

The inclination angle $\alpha$ of the first side wall 63*a* of the movable volute portion 63 is designed to be different from the inclination angle $\beta$ of the second side wall 63*b* of the movable volute portion 63. Similarly, the inclination angle $\gamma$ of the first side wall 61*a* of the fixed volute portion 61 is designed to be different from the inclination angle $\delta$ of the second side wall 61*b* of the fixed volute portion 61. Therefore, the movable volute portion 63 and the fixed volute portion 61 can be designed in accordance with the requirements of the molding procedures. This facilitates the manufacturing process.

The inclination angle $\delta$ of the second side wall 61*b* of the fixed volute portion 61 is equal to the inclination angle $\beta$ of the opposite second side wall 63*b* of the movable volute portion 63. Therefore, the compression chambers 40 are sealed and the compressor is smoothly operated.

It should be apparent to those skilled in the art that the present invention may be embodied in many other specific forms without departing from the spirit or scope of the invention. Particularly, it should be understood that the invention may be embodied in the following forms.

Each distal end portion of the fixed volute portion 34, 61 and the movable volute portion 38, 63 may be coated with a sealing layer. The sealing layer may be made of metal or resin. When the sealing layer is made of resin, the sealing member 52, 53 may be made of metal.

The present invention may be applied to a compressor with a built-in drive source (canned motor type), that is, a compressor that has an integrated electrical motor for driving the compressor.

The inclination of the volute portion of each scroll with respect to the corresponding base plate may be formed by machining the side walls.

Therefore, the present examples and embodiments are to be considered as illustrative and not restrictive and the invention is not to be limited to the details given herein, but may be modified within the scope and equivalence of the appended claims.

What is claimed is:

1. A scroll type compressor for compressing gas, the compressor comprising:

a fixed scroll, wherein the fixed scroll includes a fixed base plate and a fixed volute portion, which is formed on the fixed base plate, wherein the fixed volute portion has a pair of side walls and a proximal end and a distal end relative to the fixed base plate, and wherein the fixed volute portion is tapered and the corners of the proximal end of the fixed volute portion are arched;

a movable scroll arranged to be engaged with the fixed scroll, wherein the movable scroll includes a movable base plate and a movable volute portion, which is formed on the movable base plate, wherein the movable volute portion has a pair of side walls and a proximal end and a distal end relative to the movable base plate, and wherein the movable volute portion is tapered and the corners of the proximal end of the movable volute portion are arched, wherein, when the fixed scroll and the movable scroll are formed by molding, the fixed volute portion and the movable volute portion are formed by utilizing a draft angle required for the release from a mold, wherein each of the side walls of the fixed volute portion is inclined by different first inclination angles with respect to the fixed base plate, and each of the side walls of the movable volute portion is inclined by different second inclination angles with respect to the movable base plate, and wherein one of the side walls of the fixed volute portion is parallel to the facing one of the side walls of the movable volute portion;

a compression chamber defined between the fixed scroll and the movable scroll, wherein the compression chambers moves from a peripheral portion of the fixed volute portion toward the center as the movable scroll orbits the axis of the fixed scroll; and a plurality of sealing members, one of which is located on the fixed base plate and the other of which is located on the movable base plate.

2. The compressor according to claim 1, wherein the distal end portion of the fixed volute portion faces the movable base plate and the distal end portion of the movable volute portion faces the fixed base plate, and wherein each distal end portion of the fixed volute portion and the movable volute portion contacts the corresponding one of the sealing members.

3. The compressor according to claim 1, wherein the sealing member is resin.

4. A scroll type compressor for compressing gas, the compressor comprising:

a fixed scroll, wherein the fixed scroll includes a fixed base plate and a fixed volute portion, which is formed on the fixed base plate, wherein the fixed volute portion has a pair of side walls and a proximal end and a distal end relative to the fixed base plate, and wherein the fixed volute portion is tapered and the corners of the proximal end of the fixed volute portion are arched;

a movable scroll arranged to be engaged with the fixed scroll, wherein the movable scroll includes a movable base plate and a movable volute portion, which is formed on the movable base plate, wherein the movable volute portion has a pair of side walls and a proximal end and a distal end relative to the movable base plate, and wherein the movable volute portion is tapered and the corners of the proximal end of the movable volute portion are arched, wherein, when the fixed scroll and the movable scroll are formed by molding, the fixed volute portion and the movable volute portion are formed by utilizing a draft angle required for the release from a mold, wherein the side walls of the fixed volute portion are inclined by different first inclination angles with respect to the fixed base plate, and the side walls of the movable volute portion are inclined by different second inclination angles with respect to the movable base plate, and wherein one of the side walls of the fixed volute portion is parallel to the facing one of the side walls of the movable volute portion;

a compression chamber defined between the fixed scroll and the movable scroll, wherein the compression chamber moves from the peripheral portion of the fixed volute portion toward the center as the movable scroll orbits the axis of the fixed scroll; and a plurality of sealing members, one of which is located on the fixed base plate and the other of which is located on the movable base plate, wherein each sealing member covers the corners of the proximal end of the corresponding one of the fixed volute portion and the movable volute portion.

5. The compressor according to claim 4, wherein the distal end portion of the fixed volute portion faces the movable base plate and the distal end portion of the movable volute portion faces the fixed base plate, and wherein each distal end portion of the fixed volute portion and the movable volute portion contacts the corresponding one of the sealing members.

6. The compressor according to claim 4, wherein the sealing member is resin.

* * * * *